US011085253B2

(12) United States Patent
Cline et al.

(10) Patent No.: US 11,085,253 B2
(45) Date of Patent: Aug. 10, 2021

(54) TONG ASSEMBLY WITH DOOR POSITION SENSORS

(71) Applicant: Weatherford Technology Holdings, LLC, Houston, TX (US)

(72) Inventors: Heidi N. Cline, Cypress, TX (US); John D. Hooker, II, Cypress, TX (US); Karsten Heidecke, Houston, TX (US); Bjoern Thiemann, Burgwedel (DE); Michael Wiedecke, Salzhemmendorf (DE)

(73) Assignee: WEATHERFORD TECHNOLOGY HOLDINGS, LLC, Houston, TX (US)

( * ) Notice: Subject to any disclaimer, the term of this patent is extended or adjusted under 35 U.S.C. 154(b) by 81 days.

(21) Appl. No.: 16/671,861

(22) Filed: Nov. 1, 2019

(65) Prior Publication Data

US 2020/0141198 A1 May 7, 2020

Related U.S. Application Data

(60) Provisional application No. 62/755,019, filed on Nov. 2, 2018.

(51) Int. Cl.
*E21B 19/16* (2006.01)

(52) U.S. Cl.
CPC ..... *E21B 19/164* (2013.01)

(58) Field of Classification Search
CPC .. E21B 19/164; E21B 19/1163; E21B 19/161; E21B 19/165
See application file for complete search history.

(56) References Cited

U.S. PATENT DOCUMENTS 3,799,009 A * 3/1974 Guier ..... E21B 19/164 81/57.16
3,902,385 A * 9/1975 Haby ..... E21B 19/163 81/57.34
4,334,444 A * 6/1982 Carstensen ..... E21B 19/164 81/57.18
5,161,438 A * 11/1992 Pietras ..... E21B 19/164 81/57.16

(Continued)

FOREIGN PATENT DOCUMENTS

WO 199713618 A1 4/1997
WO 2018093540 A1 5/2018

OTHER PUBLICATIONS

Invitation to Pay Additional Fees and Partial Search Report in related Application PCT/US2019/059493 dated Feb. 11, 2020.

(Continued)

*Primary Examiner* — Kipp C Wallace
(74) *Attorney, Agent, or Firm* — Patterson + Sheridan, LLP

(57) ABSTRACT

The present disclosure generally relates to a tong assembly having position sensors for controlling door opening and closing sequence. The tong assembly includes a back section, an outer door section movably coupled to the back section, a first actuator configured to move the outer door section between an open position and a closed position, an inner door section movably coupled to the back section, a second actuator configured to move the inner door section between an open position and a closed position, a first sensor positioned to measure a position of the outer door section; and a second sensor positioned to measure a position of the inner door section.

19 Claims, 11 Drawing Sheets

(56) References Cited

U.S. PATENT DOCUMENTS

| | | | | |
|---|---|---|---|---|
| 6,279,426 | B1 | 8/2001 | Neves | |
| 6,591,471 | B1 * | 7/2003 | Hollingsworth | E21B 19/16 166/85.1 |
| 6,966,385 | B2 | 11/2005 | Hemphill et al. | |
| 2005/0188794 | A1 * | 9/2005 | Schulze-Beckinghausen | E21B 19/164 81/57.34 |
| 2015/0107420 | A1 * | 4/2015 | Webb | E21B 19/165 81/57.34 |
| 2015/0107850 | A1 * | 4/2015 | Mosing | E21B 19/165 166/377 |
| 2016/0356104 | A1 * | 12/2016 | Vierke | E21B 19/06 |
| 2017/0030153 | A1 * | 2/2017 | Weddle | E21B 19/161 |
| 2019/0143533 | A1 * | 5/2019 | Schanz | B25J 15/0206 294/203 |

OTHER PUBLICATIONS

International Search Report and Written Opinion in related Application PCT/US2019/059493 dated Apr. 8, 2020.
Internationlal Preliminary Report on Patentability in related application PCT/US2019/059493 dated Apr. 27, 2021.

* cited by examiner

TONG ASSEMBLY WITH DOOR POSITION SENSORS

CROSS-REFERENCE TO RELATED APPLICATIONS

This application claims benefit of U.S. Provisional Patent Application Ser. No. 62/755,019, filed Nov. 2, 2018, which is herein incorporated by reference.

BACKGROUND OF THE DISCLOSURE

Field of the Disclosure

The present disclosure generally relates to methods and apparatus for making up and breaking out tubular connections. More particularly, embodiments of the present disclosure relate to a tong assembly with door position sensors and methods for sequencing door sections in the tong assembly.

Description of the Related Art

Construction of oil or gas wells usually requires making long tubular strings that make up casing, risers, drill pipe, or other tubing. Due to the length of these strings, sections or stands of tubulars are progressively added to or removed from the tubular strings as they are lowered or raised from a drilling platform. A tong assembly is commonly used to make up or break out joints in the tubular strings.

A tong assembly typically includes a power tong and a backup tong. Each of the power tong and backup tong includes overlapping doors. During operation, the overlapping doors open and close sequentially to receive or release tubulars from the power tong and the backup tong. Conventionally, the opening and closing of the overlapping doors are controlled using a hydraulic sequencing block. The timing of the overlapping doors is set by tuning hydraulic valves in the hydraulic sequencing block. Because hydraulic power units used in the field vary from one another, valves in the hydraulic sequencing block are required to be adjusted while in the field. The adjustment is time consuming. Additionally, because the valves in the sequencing block are controlled using threshold pressures, sufficient clearances are included in setting threshold pressures to avoid the overlapping doors colliding with each other during the operation, which slows down the opening and closing of the overlapping doors.

Therefore, there is a need for a tong assembly with improved door control.

SUMMARY OF THE DISCLOSURE

The present disclosure generally relates to a tong assembly having position sensors for controlling door opening and closing sequence.

One embodiment provides a tong assembly, comprising a back section, an outer door section movably coupled to the back section, a first actuator configured to move the outer door section between an open position and a closed position, an inner door section movably coupled to the back section, a second actuator configured to move the inner door section between an open position and a closed position, a first sensor positioned to measure a position of the outer door section; and a second sensor positioned to measure a position of the inner door section.

Another embodiment provides a method for operating a tong assembly, comprising moving an outer door section from a closed position towards an open position while monitoring a first position sensor configured to measure a position of the outer door section, and moving the inner door section from a closed position towards an open position when a measurement of the first position sensor reaches a door opening threshold value.

Another embodiment provides a tong assembly comprising a power tong and a backup tong. The power tong includes a first frame having a first door section and a second door section, wherein the first door section and the second door section are movable between an open position and a closed position, a first sensor configured to measure a position of the first door section, and a second sensor configured to measure a position of the second door section. The backup tong includes a second frame having a third door section and a fourth door section, wherein the third door section and the fourth door section are movable between an open position and a closed position, a third sensor configured to measure a position of the third door section, and a fourth sensor configured to measure a position of the fourth door section. The tong assembly further includes a controller connected to the first, second, third, and fourth sensors and configured to open and close the power tong and the back tong according to the measurements of the first, second, third, and fourth sensors.

BRIEF DESCRIPTION OF THE DRAWINGS

So that the manner in which the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

FIG. 1A is a perspective view of the tong assembly according to one embodiment of the present disclosure.

FIG. 1B illustrates a cross section of an actuator with an exemplary embodiment of an integrated sensor. The actuator is used to open or close a door section of a tong of the tong assembly.

FIG. 1C is an enlarged view of an actuator according to another embodiment of the present disclosure with a sensor attached to the actuator. The actuator is used to open or close a door section of a tong of the tong assembly.

DETAILED DESCRIPTION

The present disclosure generally relates to a tong assembly for making up and breaking out a tubular connection such as a connection between two tubulars in a tubular string. The tubular strings may be made of tubulars that form risers, casings, drill pipes or other tubings in oil and gas wells. Embodiments of the present disclosure relate to a tong assembly including a power tong, a backup tong, and a door control system. The door control system includes a position sensor coupled to one or more door sections.

Figure 1A:
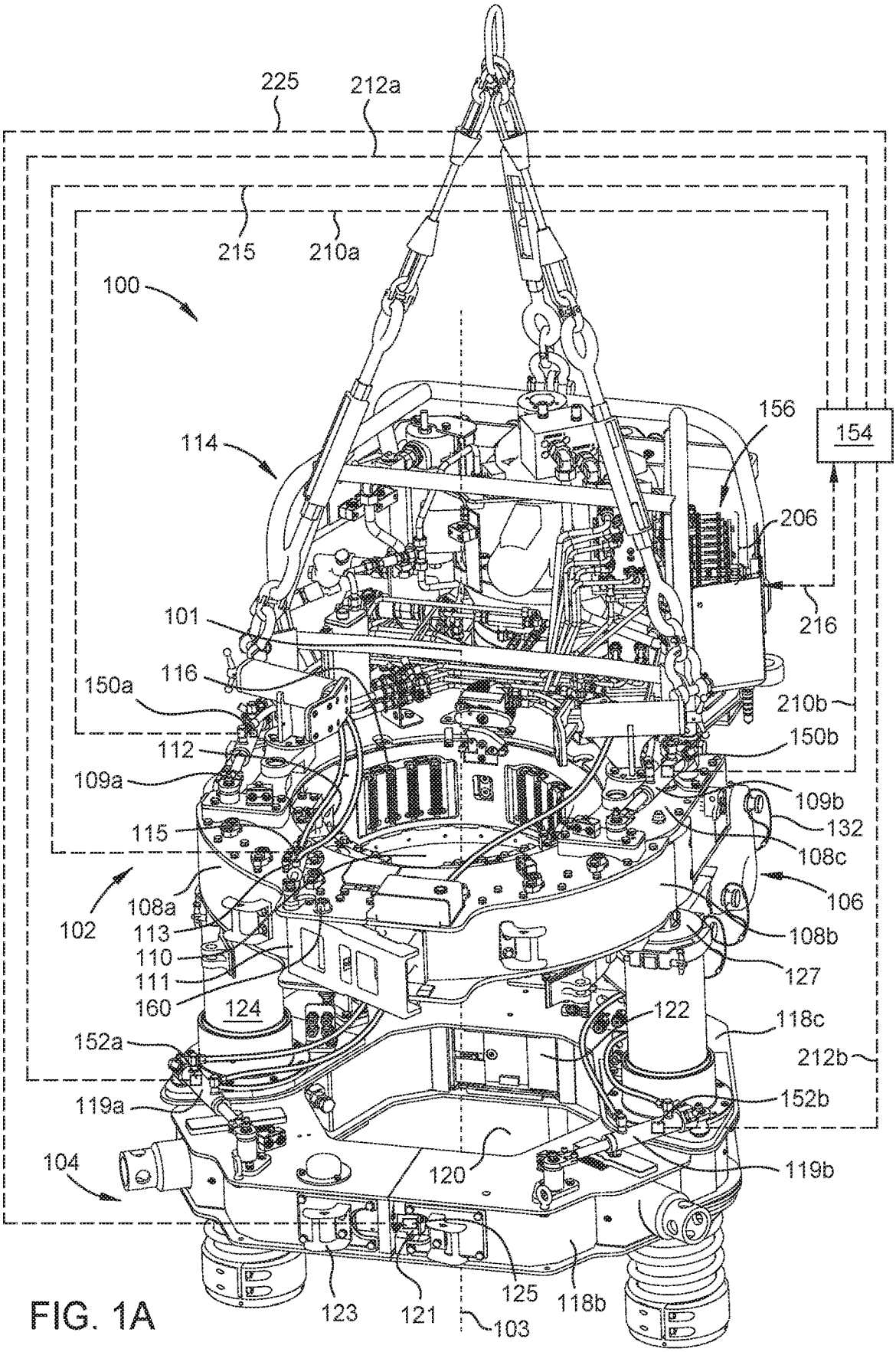
FIGS. 1A-1C illustrate a tong assembly.

FIG. 1A illustrates a tong assembly 100 according to one embodiment of the present disclosure. The tong assembly 100 includes a power tong 102 and a backup tong 104. The power tong 102 and the backup tong 104 are connected by a load transfer assembly 106. FIG. 1A illustrates both the power tong 102 and backup tong 104 in a closed position.

In some embodiments, the power tong 102 includes a frame 108 with a central opening 110 for receiving a tubular. The frame 108 includes two or more sections movable relative to each other to open and close the central opening 110. In one embodiment, the frame 108 includes an outer door section 108*a*, an inner door section 108*b*, and a back section 108*c*. The outer and inner door sections 108*a*, 108*b* are connected to the back section 108*c* by hinges and pivotable about the back section 108*c*. In one embodiment, a first actuator 109*a* is connected between the back section 108*c* and the outer door section 108*a* to pivot the outer door section 108*a* relative to the back section 108*c*. A second actuator 109*b* is connected between the back section 108*c* and the inner door section 108*b* to pivot the inner door section 108*b* relative to the back section 108*c*.

In the embodiment shown in FIG. 1A, the first and second actuators 109*a*, 109*b* are hydraulic cylinders. Each of the actuators 109*a*, 109*b* has one end coupled to the outer and inner door sections 108*a*, 108*b*, respectively, and another end coupled to the back section 108*c*. In some embodiments, and as shown in FIG. 1A, the first and second actuators 109*a,b* are positioned such that extension of the first and second actuators 109*a*, 109*b* closes the outer and inner door sections 108*a*, 108*b* respectively and retraction of the first and second actuators 109*a*, 109*b* opens the outer and inner door sections 108*a*, 108*b* respectively. In some embodiments, the first and second actuators 109*a,b* are positioned such that retraction of the first and second actuators 109*a*, 109*b* closes the outer and inner door sections 108*a*, 108*b* respectively and extension of the first and second actuators 109*a*, 109*b* opens the outer and inner door sections 108*a*, 108*b* respectively.

In some embodiments, the power tong 102 further includes a latch 111 configured to lock the first and second door sections 108*a*, 108*b* in a closed position. The latch 111 is shown in FIG. 1A as unlocked. In some embodiments, the latch 111 is connected to the outer door section 108*a* by a hinge 160. An actuator 113 is used to open and close the latch 111. In some embodiments, the actuator 113 is a hydraulic cylinder having one end attached to the latch 111 and another end attached to the door section 108*a*. In some embodiments, the actuator 113 is positioned such that extension and retraction of the actuator 113 opens and closes the latch 111 respectively. In some embodiments, and as shown in FIG. 1A, the actuator is positioned such that retraction and extension of the actuator 113 opens and closes the latch 111 respectively. Alternatively, the latch 111 can be attached to the inner door section 108*b*.

In some embodiments, the power tong 102 includes sensors positioned to monitor locations of the door sections 108*a*, 108*b*. In the embodiment shown in FIG. 1A, a first sensor 150*a* is used to obtain the position of the outer door section 108*a* relative to the back section 108*c* and a second sensor 150*b* is used to obtain the position of the inner door section 108*b* relative to the back section 108*c*.

Figure 1B:
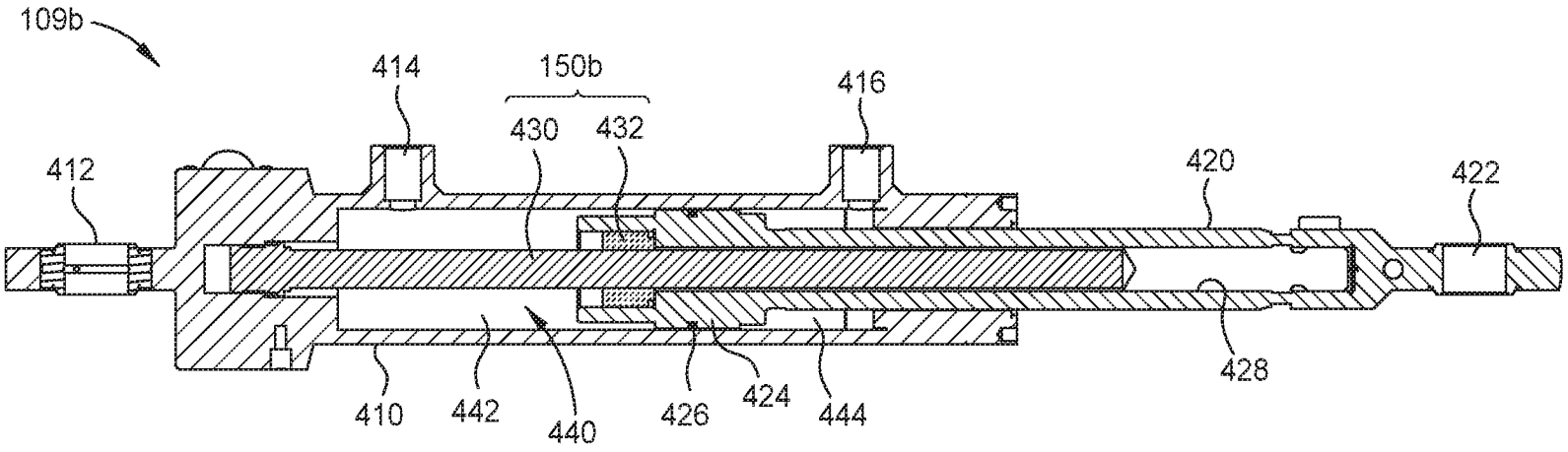

In some embodiments, the first sensor 150*a* may be integrated into the first actuator 109*a*, and the second sensor 150*b* may be integrated into the second actuator 109*b*. FIG. 1B illustrates an exemplary embodiment of the second actuator 109*b* including an exemplary integrated sensor 150*b*. As shown, the second actuator 109*b* includes a housing 410, a piston rod 420, and the second sensor 150*b*. The housing 410 includes a first coupling 412, a first port 414, and a second port 416. The first coupling 412 may be coupled to the back section 108*c*. A chamber 440 is disposed in the housing 410. The piston rod 420 includes a second coupling 422, a piston head 424, and a central bore 428. The second coupling 422 may be coupled to the door section 108*b*. The piston rod 420 is at least partially disposed in the housing 410, with the piston head 424 disposed in the chamber 440. The piston head 424 divides the chamber 440 into a first chamber portion 442 and a second chamber portion 444. In some embodiments, at least one seal 426 is disposed about the piston head 424 to seal against the housing 410. The second sensor 150*b* includes a central shaft 430 and a magnetic insert 432. The central shaft 430 is partially disposed in the central bore 428. The magnetic insert 432 is attached to the piston rod 420 and slidable along the central shaft 430. Hydraulic fluid is introduced to the first chamber portion 442 via the first port 414 to extend the second actuator 109*b* by displacing the piston rod 420. Hydraulic fluid is introduced to the second chamber portion 444 via the second port 416 to retract the second actuator 109*b* by displacing the piston rod 420. As the piston rod 420 moves in response to hydraulic fluid, the piston rod 420 and the magnetic insert 432 move relative to the central shaft 430. As will be understood by one of ordinary skill in the art, the position of the magnetic insert 432 along the central shaft 430 correlates with a position of the second actuator 109*b* and a position of the door section 108*b*. Thus, second sensor 150*b* determines the position of the door section 108*b* based on the position of the magnetic insert 432 relative to the central shaft 430. The first actuator 109*a* and the first sensor 150*a* may be the same as the second actuator 109*b* and the second sensor 150*b*.

Figure 1C:
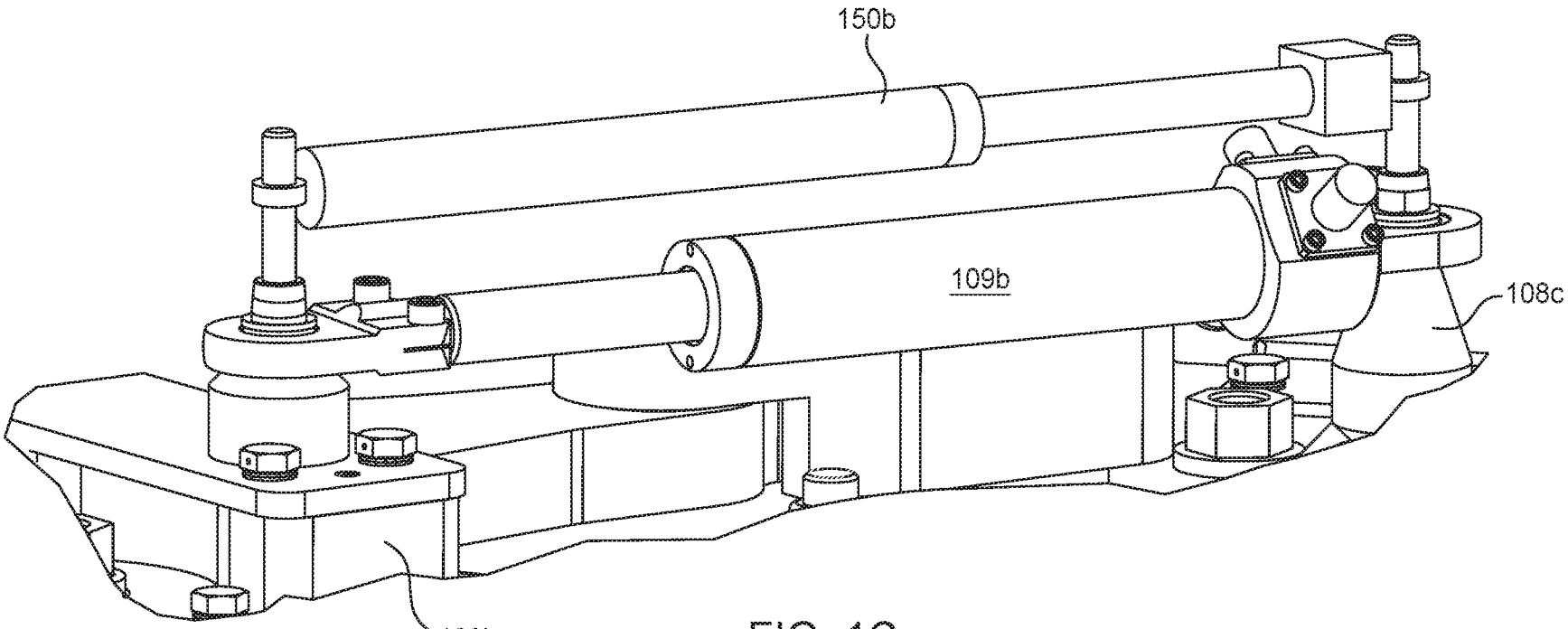

FIG. 1C is an enlarged view of the sensor 150*b* and the second actuator 109*b* according to one embodiment of the present disclosure. As shown in FIG. 1C, the second sensor 150*b* is an exemplary length transducer attached to the second actuator 109*b*. This embodiment can be used to retrofit sensors, such as 150*a*, 150*b*, onto an existing tong assembly.

In embodiments, the sensors 150*a*, 150*b* can be retrofit onto an existing tong assembly. For example, the sensor 150*a* may be retrofitted onto the actuator 109*a* and sensor 150*b* may be retrofitted onto actuator 109*b*.

In some embodiments, each of the first and second sensors 150*a*, 150*b* are a displacement sensor positioned to measure distances between a pair of fixed points between the back section 108*c* and the outer and inner door sections 108*a*, 108*b* respectively. In some embodiments, the first sensor 150*a* and second sensor 150*b* are both length transducers attached between the back section 108*c* and the outer and inner door sections 108*a*, 108*b* respectively. In some embodiments, the first and second sensors 150*a*, 150*b* are linear transducers attached to the hydraulic cylinders 109*a*, 109*b* to measure the length of the hydraulic cylinders 109*a*, 109*b* respectively. Alternatively, the first and second sensors 150*a*, 150*b* may be any suitable sensors used to obtain positions of the door sections 108*a*, 108*b*, for example, proximate sensors, rotary encoders, and the like. In some embodiments, the first sensor 150*a* is the same as the second sensor 150*b*. In some embodiments, the first sensor 150*a* is different than the second sensor 150*b*.

In some embodiments, measurements of the sensors 150*a*, 150*b* are used to control movements of the door sections 108*a*, 108*b* to avoid collisions between the outer and inner door sections 108*a*, 108*b*. The sensor measurements can be used directly or indirectly, such as through a lookup table, to control the motion of the door sections 108*a*, 108*b*.

Referring back to FIG. 1A, in some embodiments, the power tong 102 includes a latch sensor 115 configured to measure position of the latch 111. In some embodiments, the latch sensor 115 is a displacement sensor positioned to measure distances between a pair of fixed points between the door section 108*a* and the latch 111. In some embodiments, the latch sensor 115 is a length transducer attached between the door section 108*b* and the latch 111. In some embodiments, the latch sensor 115 is attached to the hydraulic cylinder 113 to measure the length of the hydraulic cylinder 113. Alternatively, the latch sensor 115 may be any suitable sensors used to obtain position of the latch 111, for example, proximate sensors, rotary encoders, and the like.

In some embodiments, the latch sensor 111 is attached to the hydraulic cylinder 113 in the manner similar to the sensor shown in FIG. 1C. In other embodiments, the latch sensor 115 is integrated to the hydraulic cylinder 113. The latch sensor 115 may be integrated into the hydraulic cylinder 113 in the manner similar to the sensor shown in FIG. 1B. In some embodiments, the latch sensor 115 is retrofitted to an existing tong assembly.

In some embodiments, measurements of the latch sensor 115 are used to control movements of the outer and inner door sections 108*a*, 108*b*. The position of the latch 111 may be used to control movements of the door sections 108*a*, 108*b*. For example, the position of the latch 111 can be used to determine whether it is clear to move the door sections 108*a*, 108*b*. The sensor measurements can be used directly or indirectly, such as through a lookup table, to obtain the position of the latch and/or to control movements of the latch 111, and the door sections 108*a*, 108*b*.

The power tong 102 further includes a rotor 112 disposed in the frame 108. In some embodiments, the rotor 112 is a segmented rotor. The rotor 112 may be coupled to a motor assembly 114. Jaws 116 may be attached to an inner diameter of the rotor 112. The jaws 116 may rotate with the rotor 112 to rotate a tubular about a central axis 101 during make up and break out of a tubular connection. The jaws 116 may move radially relative to the frame 108 to secure and release a tubular or to accommodate tubulars of various diameters. In one embodiment, the jaws 116 may be driven using a hydraulic circuit.

The backup tong 104 may be disposed underneath the power tong 102. The backup tong 104 may include a frame 118 with a central opening 120 for receiving a tubular. The frame 118 may include two or more sections movable relative to each other to open and close the central opening 120. In one embodiment, the frame 118 includes two door sections 118*a*, 118*b* and one back section 118*c*. The door sections 118*a*, 118*b* are connected to the back section 118*c* by hinges and pivotable about the back section 118*c*. In one embodiment, a first actuator 119*a* is connected between the back section 118*c* and the outer door section 118*a* to pivot the outer door section 118*a* relative to the back section 118*c* to open or close the outer door section 118*a*. A second actuator 119*b* is connected between the back section 118*c* and the inner door section 118*b* to pivot the inner door section 118*b* relative to the back section 118*c* to open or close the inner door section 118*b*.

In the embodiment shown in FIG. 1A, the first and second actuators 119*a*, 119*b* are hydraulic cylinders. Each of the actuators 119*a*, 119*b* has one end coupled to the outer and inner door section 118*a*, 118*b* respectively and another end coupled to the back section 118*c*. In some embodiments, and as shown in FIG. 1A, the first and second actuators 119*a,b* are positioned such that extension of the first and second actuators 119*a*, 119*b* closes the outer and inner door sections 118*a*, 118*b* respectively and retraction of the first and second actuators 119*a*, 119*b* opens the outer and inner door sections 118*a*, 118*b* respectively. In some embodiments, the first and second actuators 119*a,b* are positioned such that retraction of the first and second actuators 119*a*, 119*b* closes the outer and inner door sections 118*a*, 118*b* respectively and extension of the first and second actuators 119*a*, 119*b* opens the outer and inner door sections 118*a*, 118*b* respectively.

In some embodiments, the backup tong 104 further includes a latch 121 configured to lock the first and second sections 118*a*, 118*b* in a closed position. In some embodiments, the latch 121 is connected to the outer door section 118*a* by a hinge (not shown). An actuator 123 is used to open and close the latch 121. In some embodiments, the actuator 123 is a hydraulic cylinder having one end attached to the latch 121 and another end attached to the door section 118*a*. In some embodiments, the actuator 123 is positioned such that extension and retraction of the actuator 123 opens and closes the latch 121 respectively. In some embodiments, the actuator 123 is positioned such that retraction and extension of the actuator 123 opens and closes the latch 121 respectively. In other embodiments, the latch 121 is actuated by any suitable actuators, such as a motor configured to rotate the latch 121 about a hinge to open and close the latch 121. Alternatively, the latch 121 can be attached to the inner door section 118*b*.

In some embodiments, the backup tong 104 includes sensors positioned to monitor locations of the door sections 118*a*, 118*b*. In the embodiment shown in FIG. 1A, a first sensor 152*a* is used to obtain the position of the outer door section 118*a* relative to the back section 118*c* and a second sensor 152*b* is used to obtain the position of the inner door section 118*b* relative to the back section 118*c*.

In some embodiments, each of the first and second sensors 152*a*, 152*b* are a displacement sensor positioned to measure distances between a pair of fixed points between the back section 118*c* and the outer and inner door sections 118*a*, 118*b* respectively. In some embodiments, the first and second sensors 152*a*, 152*b* are length transducers attached between the back section 118*c* and the outer and inner door sections 118*a*, 118*b* respectively. In some embodiments, the first and second sensors 152*a*, 152*b* are linear transducers attached to the hydraulic cylinders 119*a*, 119*b* to measure the length of the hydraulic cylinders 119*a*, 119*b* respectively. Alternatively, the first and second sensors 152*a*, 152*b* may be any suitable sensors used to obtain positions of the door sections 118*a*, 118*b*, for example, proximate sensors, rotary encoders, and the like. In some embodiments, the first sensor 152*a* is the same as the second sensor 152*b*. In some embodiments, the first sensor 152*a* is different than the second sensor 152*b*.

In some embodiments, the sensors 152*a*, 152*b* are length transducers attached to the hydraulic cylinders 119*a*, 119*b* in the manner similar to the sensor shown in FIG. 1C. In other embodiments, the sensors 152*a*, 152*b* are integrated into the hydraulic cylinders 119*a*, 119*b*. In some embodiments, the sensors 152*a*, 152*b* are integrated into the hydraulic cylinders 119*a*, 119*b* in the manner similar to the sensor 150*b* shown in FIG. 1B.

In some embodiments, measurements of the sensors 152*a*, 152*b* are used to control movements of the door sections 118*a*, 118*b* to avoid collisions between the outer and inner door sections 118*a*, 118*b*. The sensor measurements can be used directly or indirectly, such as through a lookup table, to control the motion of the door sections 118*a*, 118*b*.

In some embodiments, the backup tong 104 includes a latch sensor 125 configured to measure position of the latch 121. In some embodiments, the latch sensor 125 is a rotation sensor, such as a rotary encoder. In other embodiments, the latch sensor 125 is a displacement sensor positioned to measure distances between a pair of fixed points between the door section 118*a* and the latch 121. For example, the latch sensor 125 is a length transducer attached to the hydraulic cylinder 123 to measure the length of the hydraulic cylinder 123. Alternatively, the latch sensor 125 may be any suitable sensors used to obtain position of the latch 121. In some embodiments, the latch sensor 125 is attached to the latch 121. In some embodiments, the latch sensor 125 is attached to a door section, such as inner door section 108*b*.

In some embodiments, the actuator 123 is a hydraulic cylinder. In some embodiments, the latch sensor 125 is attached to the hydraulic cylinder 123 in the manner similar to the sensor shown in FIG. 1C. The latch sensor 125 maybe retrofitted to an existing tong assembly. In other embodiments, the latch sensor 125 is integrated to the hydraulic cylinder 123. The latch sensor 125 may be integrated into the hydraulic cylinder 123 in the manner similar to the sensor shown in FIG. 1B.

In some embodiments, measurements of the latch sensor 125 are used to control movements of the outer and inner door sections 118*a*, 118*b*. The position of the latch 121 may used to control movements of the door sections 118*a*, 118*b*. For example, the position of the latch 121 can be used to determine whether it is clear to move the door sections 118*a*, 118*b*. The sensor measurements can be used directly or indirectly, such as through a lookup table, to obtain the position of the latch and/or to control movements of the latch 121, and the door sections 118*a*, 118*b*.

The backup tong 104 further includes jaws 122 attached to the frame 118. The jaws 122 may move radially relative to the frame 118 to secure and release a tubular or to accommodate tubular of various diameters. In some embodiments, the jaws 122 may are driven using a hydraulic circuit. The frame 118 of the backup tong 104 may be movably coupled to support legs 124. The support legs 124 are configured to stand on a platform or other stationary planes. The support legs 124 support the backup tong 104 and prevent the backup tong 104 from rotating during operation.

In one embodiment, the power tong 102 may include alignment posts 127 extending from a lower side of the frame 108. When the tong assembly 100 is assembled, the alignment posts 127 may be inserted into the support legs 124 so that the central axis 101 of the power tong 102 and the central axis 103 of the backup tong 104 may be substantially aligned. The inner diameter of the support legs 124 is substantially larger than the outer diameter of the alignment posts 127 so that the power tong 102 may move relative to the backup tong 104 within a limited range without the alignment posts 127 contacting the support legs 124. When the alignment posts 127 do not contact the support legs 124, torsion and force are not transmitted between the support legs 124 and the alignment posts 127.

The power tong 102 and the backup tong 104 are connected through the load transfer assembly 106. The load transfer assembly 106 may include a torsion bar 132, and at least one load cell (not shown).

The tong assembly 100 further includes a controller 154. The sensors 150*a*, 150*b*, 115, 152*a*, 152*b*, 125 are connected to the controller 154. The controller 154 gathers the measurements of the sensors 150*a*, 150*b*, 115, 152*a*, 152*b*, 125 and generates commands to the actuators 109*a*, 109*b*, 113, 119*a*, 119*b*, 123 based on the sensor measurements. In some embodiments, the controller 154 is connected to a hydraulic manifold 156 and sends commands to the hydraulic manifold 156. The hydraulic manifold 156 includes valves 206 configured to selectively connect a hydraulic power unit 208 to the actuators 109*a*, 109*b*, 113, 119*a*, 119*b*, 123 of the power tong 102 and the backup tong 104.

During an operation, the tong assembly 100 is first moved to the location of the tubular string to be operated. The tong assembly 100 may be moved using an overhead handling tool, a track on the platform, or a positioning device. The frames 108, 118 of the power tong 102 and the backup tong 104 may be in the open position to receive the tubular string in the openings 110, 120, and the central axes 101,103 of the power tong 102 and backup tong 104, respectively, are aligned with longitudinal axis of the tubular string. The door sections 108*a*, 108*b* and door sections 118*a*, 118*b* are then closed so that the jaws 116 and the jaws 122 may secure the tubular string. When the tong assembly 100 is in the position for making up or breaking out a connection, the tubular string is secured by the jaws 122 of the backup tong 104 and the tubular section to be joined or removed is secured by the jaws 116 of the power tong 102.

According to embodiments of the present disclosure, the door opening and closing of the power tong 102 and the backup tong 104 are achieved using the door position sensors discussed above and control modules in a controller.

Figure 2:
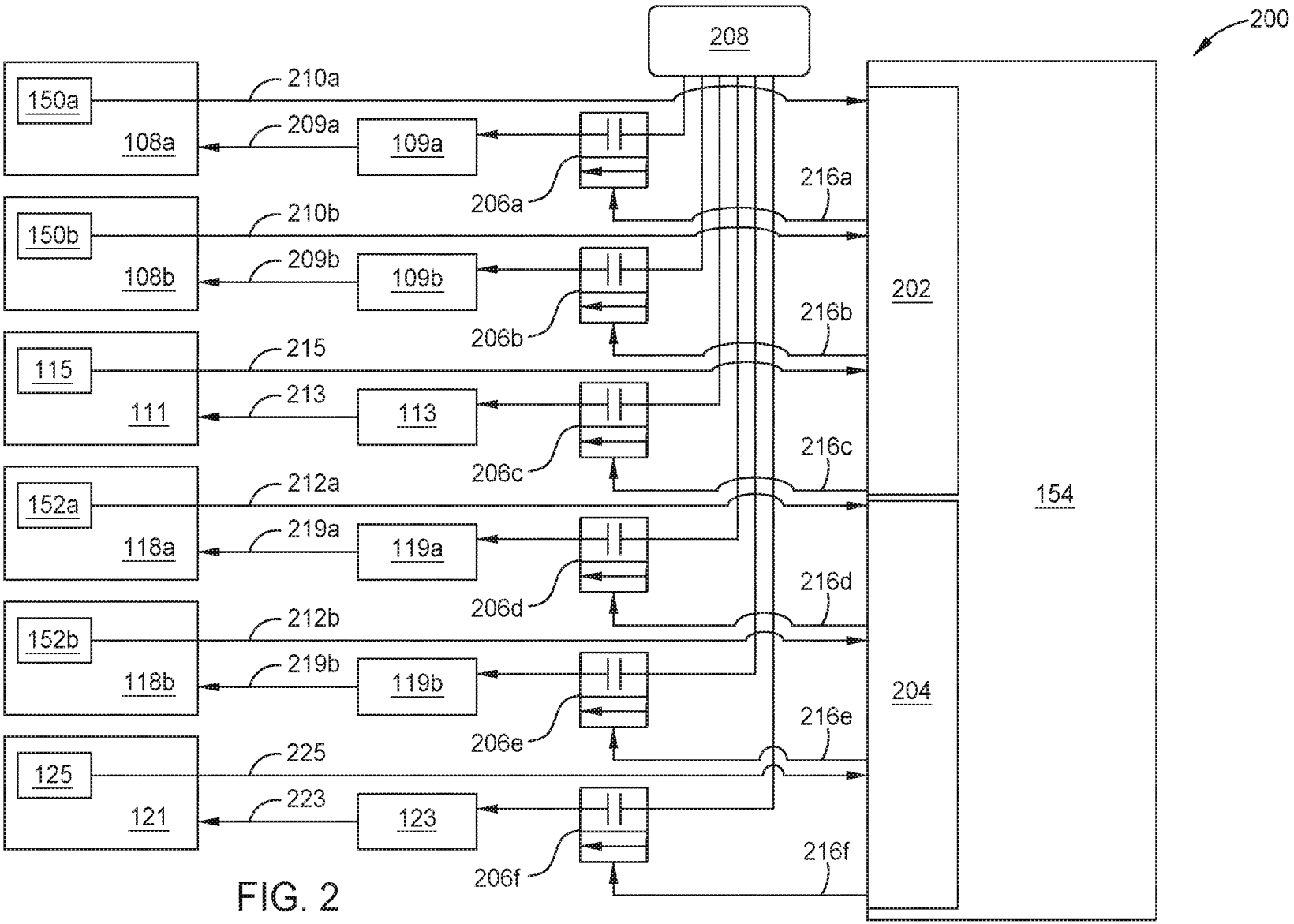
FIG. 2 is a schematic plan view of a door control system according to one embodiment of the present disclosure.

FIG. 2 is a schematic plan view of a door control system 200 according to one embodiment of the present disclosure. The door control system 200 includes the controller 154, the hydraulic manifold 156, the actuators 109*a,b*, 119*a,b*, 113, 123, and the sensors 150*a*, 150*b*, 115, 152*a*, 152*b*, 125. In some embodiments, the controller 154 includes control modules 202, 204 configured to control a door open sequence and a door closing sequence for the power tong 102 and the backup tong 104 respectively. The controller 154 is connected to the sensors 150*a*, 150*b*, 115, 152*a*, 152*b*, 125 to receive sensor measurements. The connection between the controller 154 and the sensors 150*a,b*, 115, 152*a,b*, and 125 may be a wired connection or a wireless connection such that the aforementioned sensors communicate with the controller 154. The connection between the sensors 150*a,b* and the controller 154, such as with the control module 202, is shown as line 210*a,b* respectively. The connection between sensors 152*a,b* and the controller 154, such as control module 204, is shown as line 212*a,b* respectively. The connection between the latch sensor 115 and the controller 154, such as with the control module 202, is shown as the line 215. The connection between the latch sensor 125 and the controller 154, such as with the control module 204, is shown as the line 225. The controller 154 is connected to the hydraulic manifold 156, and the connection is shown as line 216 in FIG. 1. As shown in FIG. 2, the hydraulic manifold 156 includes valves 206*a-f*. The controller 154 sends commands to valves 206*a-f* positioned to selectively connect the actuators 109*a*, 109*b*, 113, 119*a*, 119*b*, 123 to a hydraulic power unit 208. The communication between the valve 206*a* and the controller 154, such as control module 202, is illustrated as line 216*a*. The communication between the valve 206*b* and the controller 154, such as control module 202, is illustrated as line 216*b*. The communication between the valve 206*c* and the controller 154, such as control module 202, is illustrated as line 216*c*. The communication between the valve 206*d* and the controller 154, such as control module 204, is illustrated as line 216*d*. The communication between the valve 206*e* and the controller 154, such as control module 204, is illustrated as line 216*e*. The communication between the valve 206*f* and the controller 154, such as control module 204, is illustrated as line 216*f*.

As shown in FIG. 2, the control module 202 controls the opening and closing of the door sections 108*a*, 108*b* of the power tong 102. The control module 202 is operably coupled to valves 206*a-c* and to sensors 150*a*, 150*b*, and 115. The control module 202 may command the valve 206*a* to actuate actuator 119*a* to open or close the door section 108*a*. The actuation of the actuator 109*a* to open or close the door section 108*a* is illustrated as line 209*a*. The control module 204 may command the valve 206*b* to actuate actuator 109*b* to open or the close door section 108*b*. The actuation of the actuator 109*b* to open or close the door section 108*b* is illustrated as line 209*b*. The control module 202 may command the valve 206*c* to actuate the actuator 113 to open (unlock) or close (lock) the latch 111. The actuation of the actuator 113 to open or close the latch 111 is illustrated as line 213. The control module 202 monitors sensor measurements from the sensors 150*a*, 150*b*, and the latch sensor 115 and uses the sensor measurements to determine the positions of the door sections 108*a*, 108*b*, and the latch 111 in the power tong 102. In some embodiments, the control module 202 determines the positions of door sections 108*a*, 108*b* by converting measurements from displacement sensors to door opening angles, for example angles between the door sections 108*a*, 108*b* and the back section 108*c*. In some embodiments, the control module 202 includes a lookup table to convert the sensor measurements to door opening angles. The lookup table is obtained through empirical methods. In some embodiments, the control module 202 is configured to start and stop actuators 109*a*, 109*b* when sensor measurements reach threshold values. For example, the control module 202 opens or closes the door sections 108*a*, 108*b* when the door opening angles corresponding to the sensor measurements reach opening or closing door angles. In some embodiments, the control module 202 monitors positions of the latch 111 according to the latch sensor 115. The door sections 108*a*, 108*b* may be opened or closed based on the position of the latch 111. In some embodiments, the control module 202 includes a latch position lookup table to convert the latch sensor 115 measurements to latch positions. The latch position lookup table is obtained by empirical methods.

As shown in FIG. 2, the control module 204 controls the opening and closing of the door sections 118*a*, 118*b* of the backup tong 104. The control module 204 is operably coupled to valves 206*d-f* and to sensors 152*a*, 152*b*, and 125. The control module 204 may command the valve 206*d* to actuate actuator 119*a* to open or close door section 118*a*. The actuation of the actuator 119*a* to open or close the door section 118*a* is illustrated as line 219*a*. The control module 204 may command the valve 206*e* to actuate actuator 119*b* to open or close door section 118*b*. The actuation of the actuator 119*b* to open or close the door section 118*b* is illustrated as line 219*b*. The control module 204 may command the valve 206*f* to actuate the actuator 123 to open (unlock) or close (lock) the latch 121. The actuation of the actuator 123 to open or close the latch 121 is illustrated as line 223. Similarly to the control module 202, the control module 204 monitors sensor measurements from the sensors 152*a*, 152*b*, and the latch sensor 125 and uses the sensor measurements to determine the positions of the door sections 118*a*, 118*b*, and the latch 121 in the backup tong 104. In some embodiments, the control module 204 determines the positions of door sections 118*a*, 118*b* by converting measurements from displacement sensors to door opening angles, for example, angles between the door sections 118*a*, 118*b* and the back section 118*c*. In some embodiments, the control module 204 includes a lookup table to convert the sensor measurements to door opening angles. The lookup table is obtained through empirical methods. In some embodiments, the control module 204 is configured to start and stop actuators 119*a*, 119*b* when sensor measurements reach threshold values. For example, the control module 204 opens or closes the door sections 118*a*, 118*b* when the door opening angles corresponding to the sensor measurements reach opening or closing door angles. In some embodiments, the control module 204 monitors positions of the latch 121 according to the latch sensor 125. The door sections 118*a*, 118*b* may be opened or closed based on the position of the latch 121. In some embodiments, the control module 204 includes a latch position lookup table to convert the latch sensor 125 measurements to latch positions. The latch position lookup table is obtained by empirical methods.

In some embodiments, the control modules 202, 204 control opening and closing operations in the power tong 102 and the backup tong 104 in parallel. In some embodiments, the control modules 202, 204 coordinate with each other during operation to complete tubular makeup or break out processes. For example, the control modules 202, 204 open or close the power tong 102 and the backup tong 104 simultaneously. In some embodiments, the control module 202 opens or closes the power tong 102 before the control module 204 opens or closes the backup tong 104, and vice versa. In some embodiments, the control module 202 opens or closes the power tong 102 after the control module 204 has partially opened or closed the backup tong 104, and vice versa.

FIGS. 3A-3F illustrate an exemplary door opening sequence and an exemplary door closing sequence of the power tong 102 in the tong assembly 100 according to one embodiment of the present disclosure. The door opening and the closing sequences can be performed using the tong assembly 100, such as the tong assembly 100 illustrated in FIG. 1A, and the door control system 200 of FIG. 2.

Figure 3A:
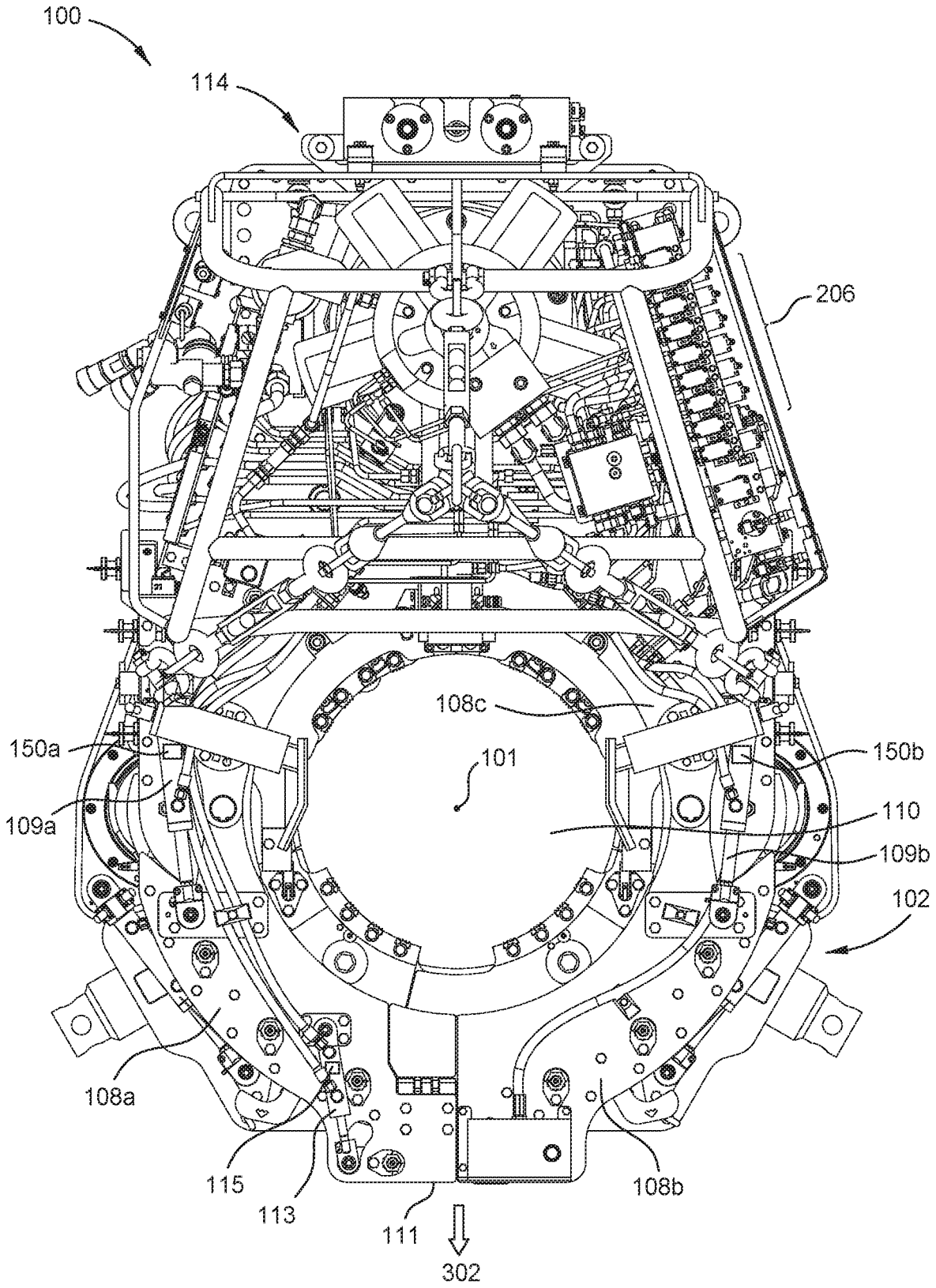
FIGS. 3A-3F illustrate a door opening sequence and a door closing sequence according to one embodiment of the present disclosure.

In FIG. 3A, the door sections 108*a*, 108*b* are in the closed position and the latch 111 is in the closed position to lock the door section 108*a*, 108*b* in the closed position. An unlocking operation 302 starts upon occurrence of a door opening event, such as the completion of a makeup or break out operation or the initiation of a new makeup or break out operation. The unlocking operation 302 includes opening the latch 111 to disengage the latch 111 and the door section 108*b*. In some embodiments, the unlocking operation 302 is performed by sending an open command from the control module 202 to the control valve 206*c* to supply hydraulic power to the latch actuator 113.

Figure 3B:
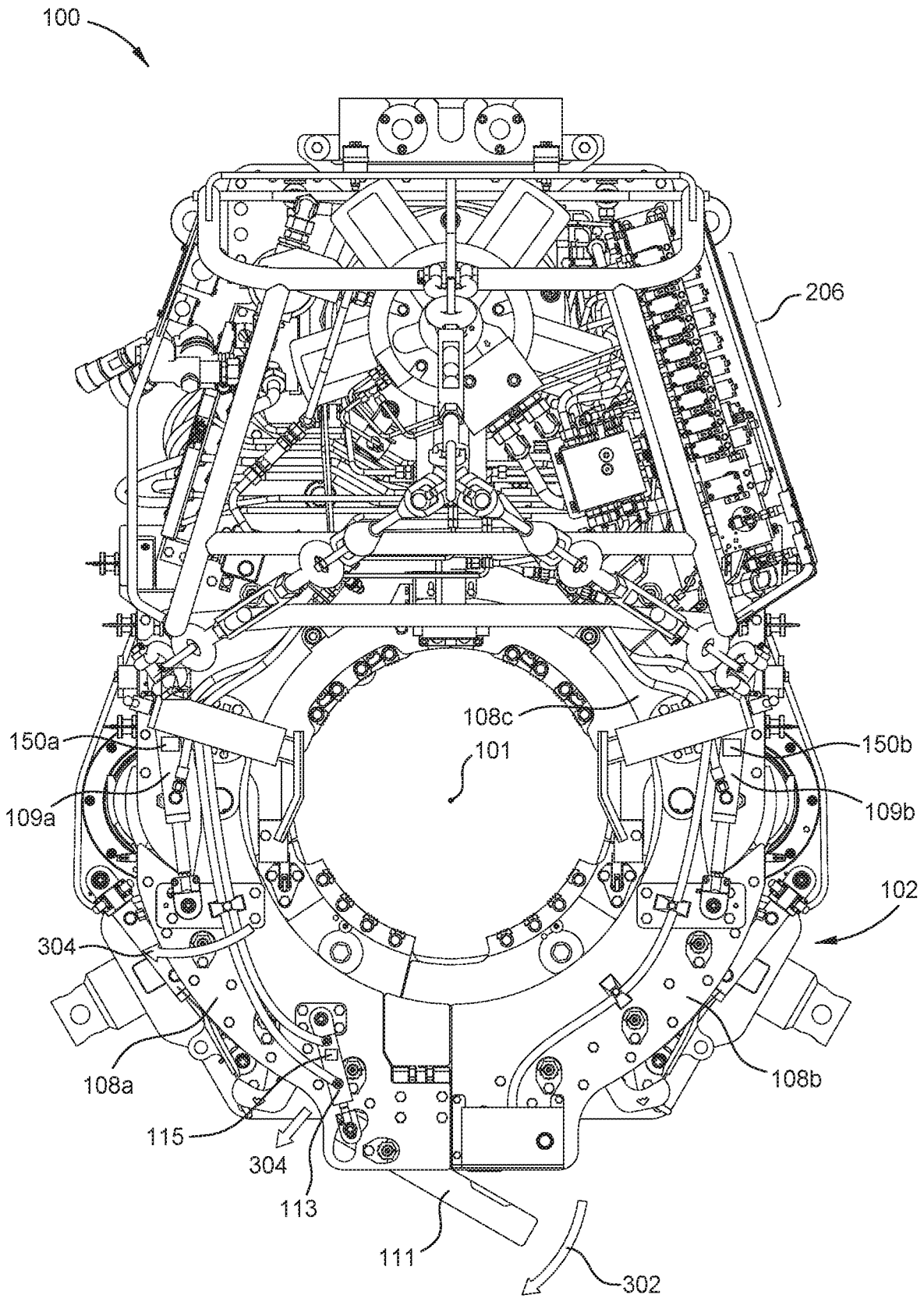

In FIG. 3B, an outer door opening operation 304 starts upon disengagement of the latch 111 and the door section 108*b*. The outer door opening operation 304 includes rotating the door section 108*a*. In some embodiments, the outer door opening operation 304 is performed by sending an open command from the control module 202 to the control valve 206*a* to supply hydraulic power to the actuator 109*a*. In some embodiments, the outer door opening operation 304 and the unlocking operation 302 are performed simultaneously until the latch 111 opens completely. In some embodiments, the latch 111 is in the open position before the outer door opening operation 304 begins.

In some embodiments, measurement of the latch sensor 115 is monitored in real time to determine whether the latch 111 and the door section 108*b* are disengaged from each other. For example, the latch 111 is disengaged when the measurement of the latch sensor 115 reaches a latch disengagement threshold value. In some embodiments w the latch sensor 115 is a length transducer attached to the hydraulic cylinder 113, and the length measured by the latch sensor 115 reduces as the latch 111 opens. In one embodiment, the latch disengagement threshold value is a length value corresponding to the length of the hydraulic cylinder 113 when the latch 111 and the door section 108*b* are no longer in contact. In some embodiments, the latch disengagement threshold value is obtained through experiments. The latch disengagement threshold value can be set at the assembly of the power tong 102 and does not need to be readjusted or fine-tuned when the tong assembly 100 is moved to a new work site or connected to a new hydraulic power unit. The latch 111 and the door section 108*b* are disengaged when the length measured by the latch sensor 115 equals to or is less than the latch disengagement threshold value. In other embodiments, in the absence of the latch sensor 115, the outer door opening operation 304 may start after a predetermined time after the unlocking operation or after a pressure in the hydraulic line connecting the latch actuator 113 reaches a predetermined value.

Figure 3C:
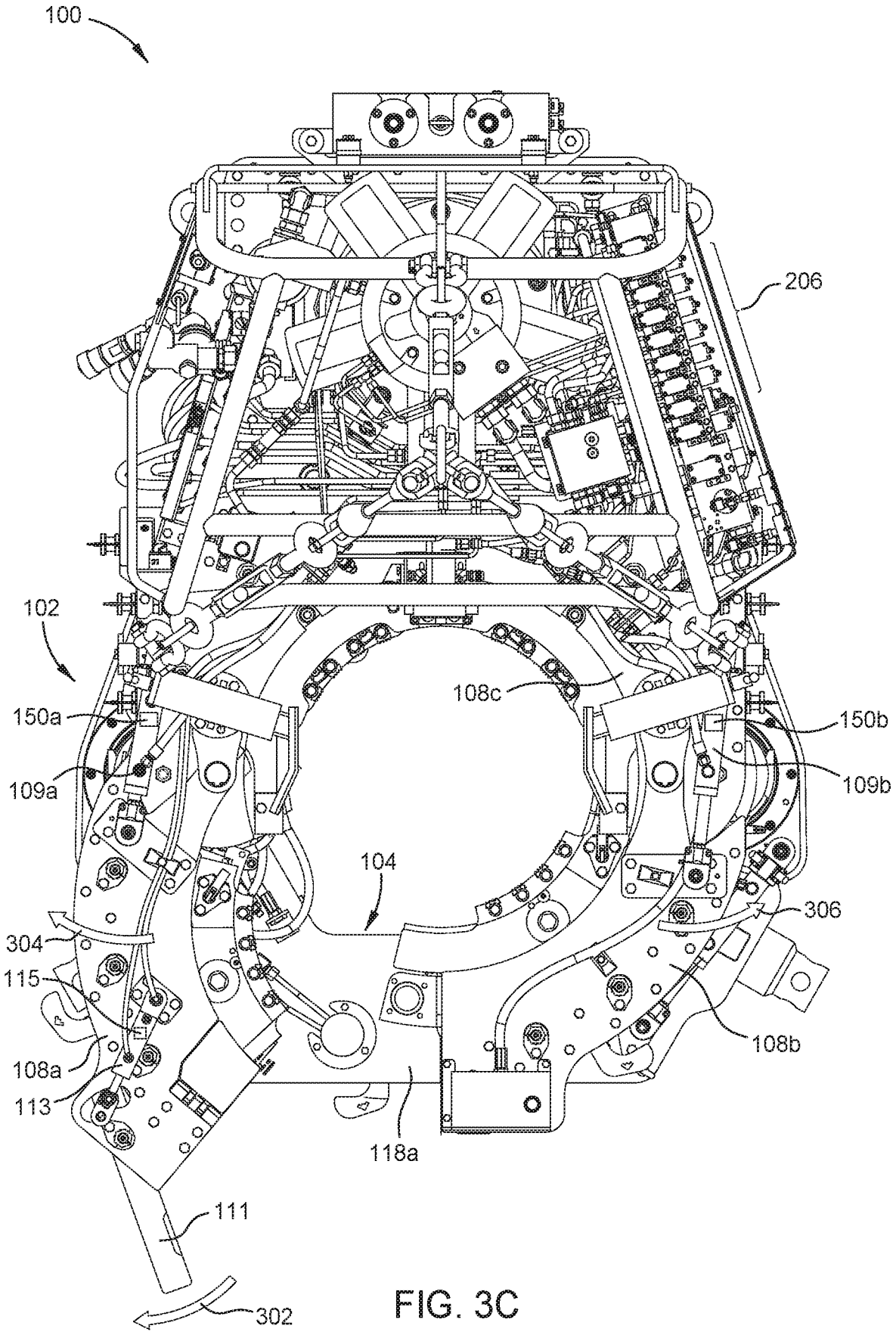

In FIG. 3C, an inner door opening operation 306 may start when the door section 108*a* is clear from a trajectory of the door section 108*b*. The inner door opening operation 306 includes rotating the door section 108*b*. In some embodiments, the inner door opening operation 306 is performed by sending an open command from the control module 202 to the control valve 206*b* to supply hydraulic power to the actuator 109*b*. In some embodiments, the inner door opening operation 306 and the outer door opening operation 304 are performed simultaneously until the door sections 108*a,b* open completely. In some embodiments, the unlocking operation 302 may be performed simultaneously with the outer door opening operation 304 and the inner door opening operation 306.

In some embodiments of the inner door opening operation 306, measurement of the sensor 150*a* is monitored in real time to determine whether the door section 108*a* is clear from a trajectory of the door section 108*b*. For example, the door section 108*a* is clear from a trajectory of the door section 108*b* when the measurement of the sensor 150*a* reaches a door open threshold value. In some embodiments, the sensor 150*a* is a length transducer attached to the hydraulic cylinder 109*a*, and the length measured by the sensor 150*a* reduces as the door section 108*a* opens. In one embodiment, the door open threshold value is a length value corresponding to the length of the hydraulic cylinder 109*a* when any portion of the door section 108*a* will not collide with the door section 108*b* if the door section 108*b* rotates open. In some embodiments, the door open threshold value is a length value corresponding to a position of the door section 108*a* when any portion of the door section 108*a* is not in contact with the door section 108*b* and the distance between door sections 108*a* and 108*b* is large enough to avoid collision between the door sections 108*a*, 108*b* if the door section 108*b* rotates open. The door section 108*a* is clear from a trajectory of the door section 108*b* when the length measured by the sensor 150*a* is equal to or less than the door open threshold value. In some embodiments, the door open threshold value is obtained through experiments. The door open threshold value can be set at assembly of the power tong 102 and does not need to be readjusted or fine-tuned when the tong assembly 100 is moved to a new work site or connected to a new hydraulic power unit.

In some embodiments, during the inner door opening operation 306, the measurements of the sensors 150*a*, 150*b* are continuously monitored to avoid collision of the door sections 108*a*, 108*b*. In some embodiments, a lookup table including correlation between the door positions 108*a*, 108*b* is used to detect potential collision between the door sections 108*a*, 108*b*. The lookup table is obtained through empirical methods.

Figure 3D:
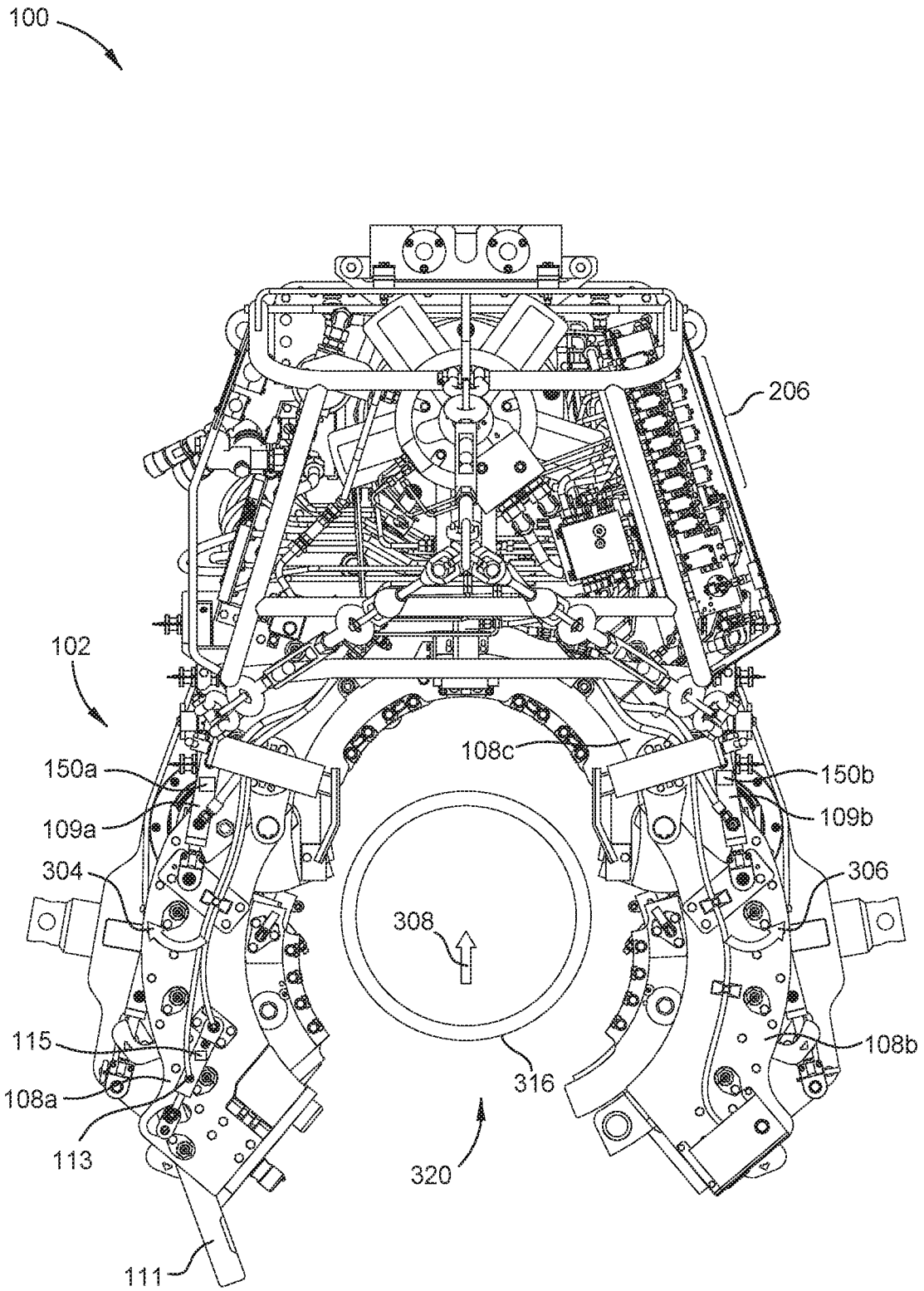

In FIG. 3D, both inner door opening operation 306 and the outer door opening operation 304 stop when the door sections 108*a*, 108*b* are fully open. For example, the door sections 108*a*, 108*b* may be fully open when an opening 320 between the door sections 108*a*, 108*b* are large enough to receive or release a tubular 316 there through. The tubular 316 can be any suitable tubular structures used in the oil and gas field, such as a drill pipe, a casing pipe, a production pipe, or a tubular body of a sub. In some embodiments, measurements of the sensors 150*a*, 150*b* are used to determine whether the door sections 108*a*, 108*b* are fully open. In some embodiments, preset values are used to determine the status of the door sections 108*a*, 108*b*. For example, the door opening operations 304, 306 stop when measurement of the sensor 150*a*, 150*b* reaches the corresponding preset values. Once the door sections 108*a*, 108*b* are fully open, a tubular exchange operation 308 may begin. As shown in FIG. 3D, a tubular 316 is inserted into the power tong 102 via the opening 320. In one embodiment, the tubular exchange operation 308 includes moving the power tong 102 relative to the tubular 316 so the tubular 316 passes through the opening 320.

Figure 3E:
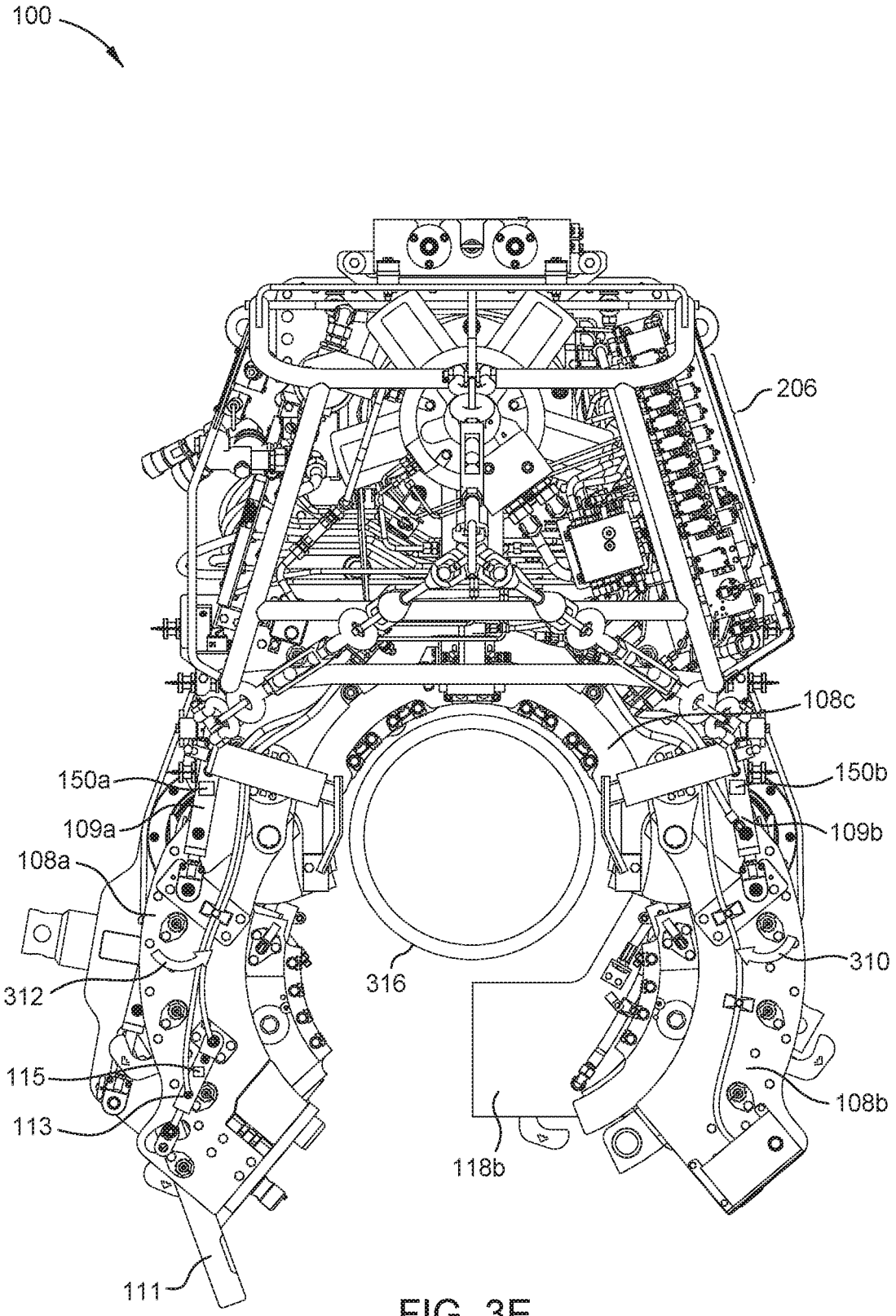
Figure 3F:
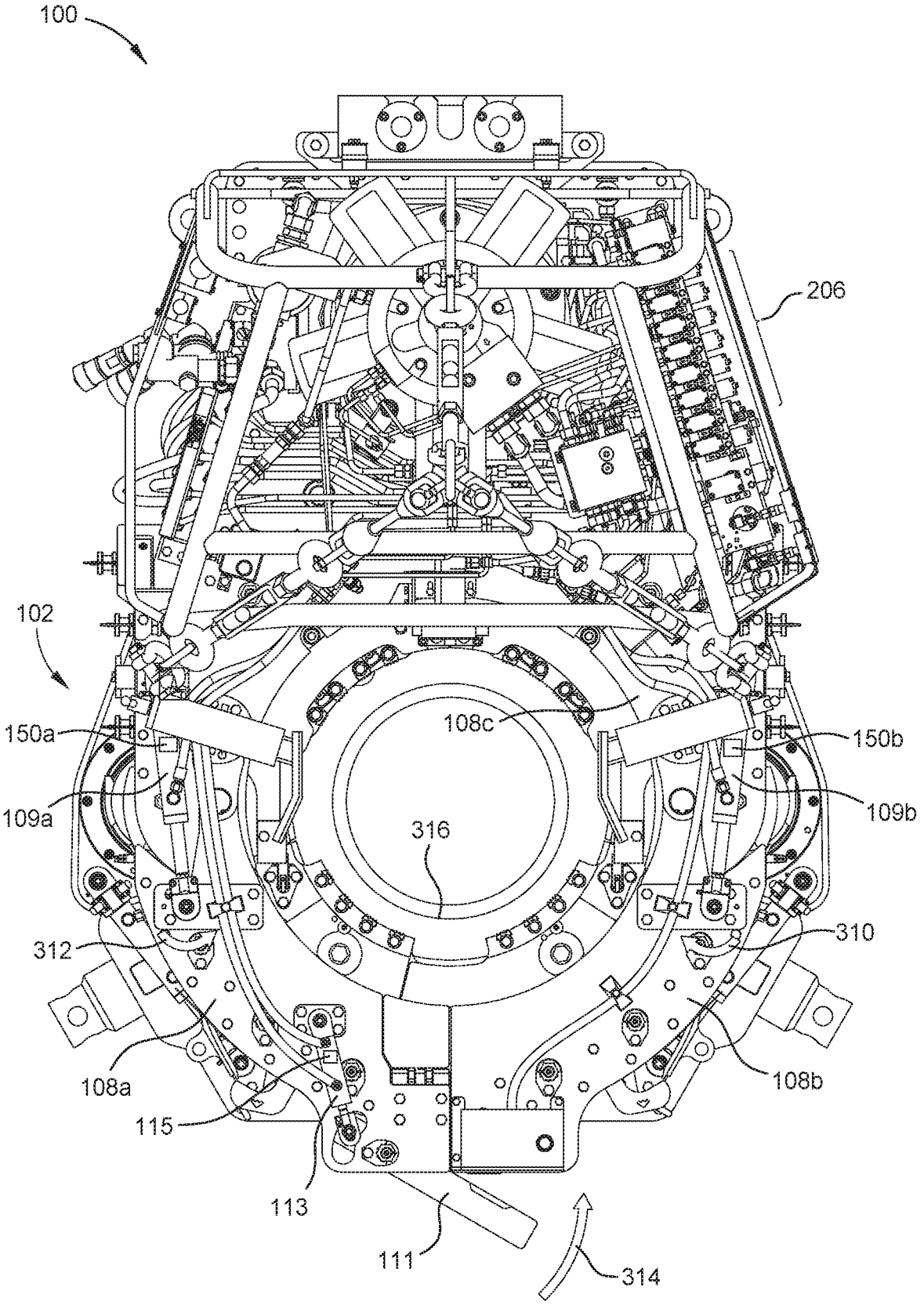

After the tubular exchange operation 308 is complete, the door sections 108*a*, 108*b* can be closed to perform a makeup or break out operation. FIGS. 3E and 3F illustrate a door closing sequence.

In FIG. 3E, an inner door closing operation 310 is first performed to start the door closing sequence. The inner door closing operation 310 includes rotating the door section 108*b*. In some embodiments, the inner door closing operation 310 is performed by sending a close command from the control module 202 to the control valve 206*b* to supply hydraulic power to the actuator 109*b*.

As shown in FIG. 3E, an outer door closing operation 312 starts upon the door section 108*b* is clear from a trajectory of the door section 108*a*. The outer door closing operation 312 includes rotating the door section 108*a*. In some embodiments, the outer door closing operation 312 is performed by sending a close command from the control module 202 to the control valve 206*a* to supply hydraulic power to the actuator 109*a*. In some embodiments, the outer door closing operation 312 and the inner door closing operation 310 are performed simultaneously until the door sections 108*a,b* close completely.

In some embodiments of the outer door closing operation 312, measurement of the sensor 150*b* is monitored in real time to determine whether the door section 108*b* is clear from a trajectory of the door section 108*a*. For example, the door section 108*b* is clear from a trajectory of the door section 108*a* when the measurement of the sensor 150*b* reaches a door close threshold value. In some embodiments, the sensor 150*b* is a length transducer attached to the hydraulic cylinder 109*b*, and the length measured by the sensor 150*b* increases as the door section 108*b* closes. In one embodiment, the door close threshold value is a length value corresponding to the length of the hydraulic cylinder 109*b* when any portion of the door section 108*a* will not collide with the door section 108*b* if the door section 108*a* rotates close. In some embodiments, the door close threshold value is a length value corresponding to a position of the door section 108*b* when the door section 108*b* reaches a position that closing motion of door section 108*b* is sufficiently ahead of the closing motion of the door section 108*a* to avoid collision between the door sections 108*a*, 108*b*. The door section 108*b* is clear from a trajectory of the door section 108*a* when the length measured by the sensor 150*b* equals to or is greater than the door close threshold value. In some embodiments, the door close threshold value is obtained through experiments. The door close threshold value can be set at the assembly of the power tong 102 and does not need to be readjusted or fine-tuned when the tong assembly 100 is moved to a new work site or connected to a new hydraulic power unit.

In some embodiments, during the outer door closing operation 312, the measurements of the sensors 150*a*, 150*b* are continuously monitored to avoid collision of the door sections 108*a*, 108*b*. In some embodiments, a lookup table including correlation between the door positions 108*a*, 108*b* is used to detect potential collision between the door sections 108*a*, 108*b*. The lookup table is obtained through empirical methods.

In FIG. 3F, a locking operation 314 to close the latch 111 may start when the door section 108*b* reaches the closed position. The door section 108*b* may be engaged with the door section 108*a* when in the closed position. The locking operation 314 includes closing the latch 111 to engage the latch 111 and the door section 108*b*. In some embodiments, the locking operation 314 is performed by sending a close command from the control module 202 to the control valve 206*c* to supply hydraulic power to the latch actuator 113. In some embodiments, the outer door closing operation 312 and the locking operation 314 are performed simultaneously until the latch 111 engages the door section 108*b*. In some embodiments, the locking operation 314 may be performed simultaneously with the outer door closing operation 312 and the inner door closing operation 310. The locking operation is complete when the latch 111 locks the first and second door sections 108*a*, 108*b* in their respective closed positions.

In some embodiments, measurements of the sensors 150*a*, 150*b* are monitored in real time to determine whether it is time to perform the locking operation 314. In one embodiment, the lock threshold values are used to initiate the locking operation 314. In one embodiment, the lock threshold values include length values corresponding to the lengths of the actuators 109*a,b* and 113 when closing of the latch 111 does not causing collision with the door section 108*b*, such as when the door section 108*b* is being closed. In some embodiments, the lock threshold values are obtained through experiments. The lock threshold value can be set at the assembly of the power tong 102 and does not need to be readjusted or fine-tuned when the tong assembly 100 is moved to a new work site or connected to a new hydraulic power unit.

Figure 4:
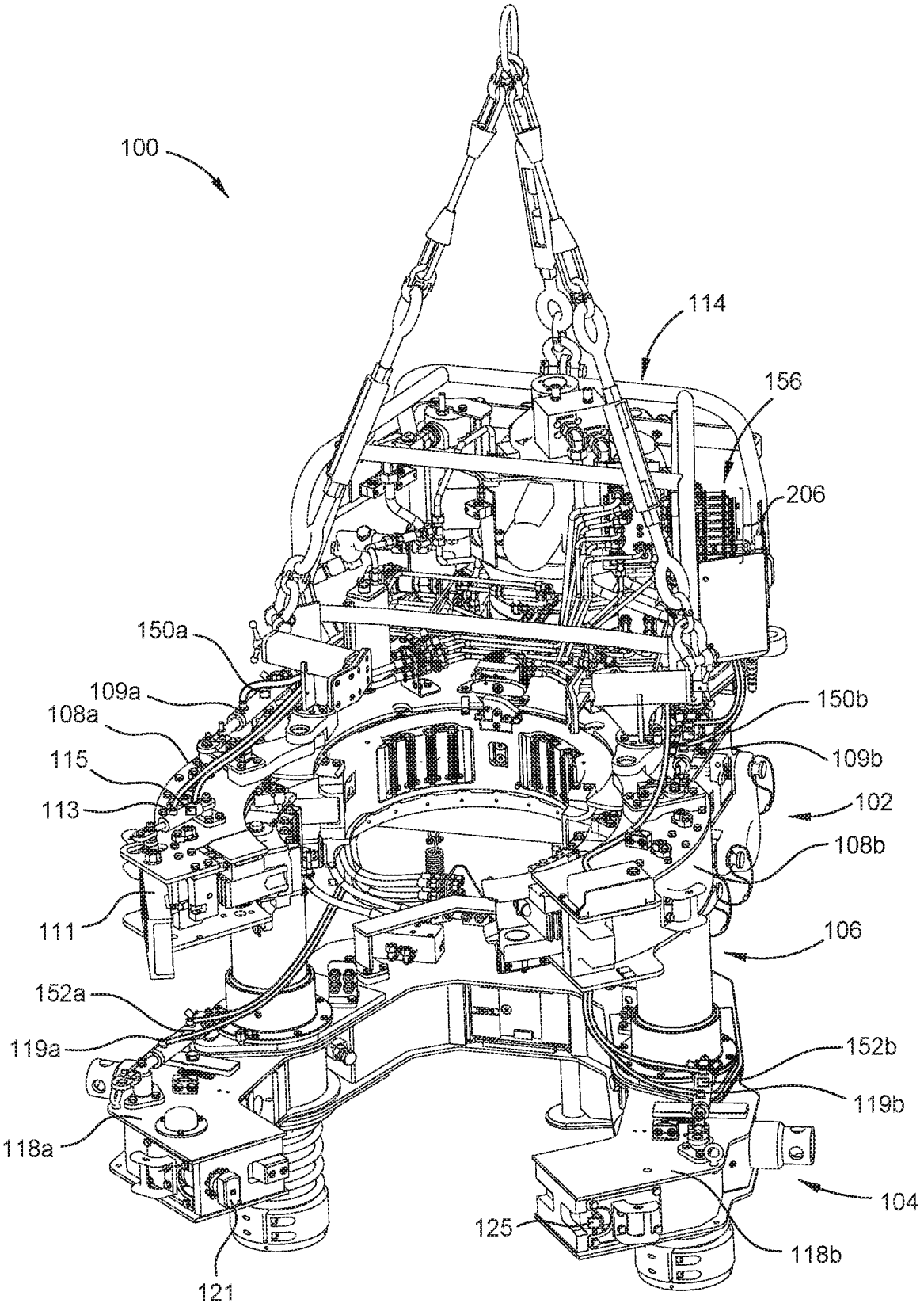
FIG. 4 illustrates the tong assembly with an open power tong and an open backup tong.

The backup tong 104 in the tong assembly 100 can be opened and closed in the similar manner as the power tong 104 as shown in FIGS. 3A-3F. In some embodiments, the control module 204 continuously monitors the sensors 152*a*, 152*b* to avoid collisions of door sections 118*a*, 118*b* during an opening or closing operation of the backup tong 104. In some embodiments, the door sections 118*a*, 118*b* may be opened or closed based on the position of the latch 121 measured by the latch sensor 125. As shown in FIG. 4, both the power tong 102 and the backup tong 104 are open.

Upon closing and locking of the door sections 108*a*, 108*b* in the power tong 102 and the closing and locking of door sections 118*a*, 118*b* in the backup tong 104, a tubular operation, such as a makeup or break out operation can be performed by the tong assembly.

In some embodiments, the controller 154 controls the speed of extension or retraction of the actuators 109*a,b* to control the speed of opening or closing of the door sections 108*a,b*, respectively. Thus, during a door opening sequence, the controller 154 controls the speed of opening the door sections 108*a,b* to avoid collisions between the door sections 108*a,b*. For example, as the outer door section 108*a* opens, the controller 154 commands the actuator 109*b* to open the inner door section 108*b*. The controller 154 controls the speed at which the inner door section 108*b* opens such that the inner door section 108*b* does not collide with the opening door section 108*a* by monitoring the position of the door sections 108*a,b* with their respective sensors 150*a,b*. As a result, the controller 154 maintains a clearance between the opening door sections 108*a,b*. During a door closing operation, the controller 154 controls the speed of closing the door sections 108*a,b* to avoid collisions between the door sections 108*a,b*. For example, as the inner door section 108*b* closes, the controller 154 commands the actuator 109*a* to close the outer door section 108*a*. The controller 154 controls the speed at which the outer door section 108*a* closes such that the outer door section 108*a* does not collide with the closing inner door section 108*b* by monitoring the position of the door sections 108*a,b* with their respective sensors 150*a,b*. As a result, the controller 154 maintains a clearance between the closing door sections 108*a,b*. The controller 154 may control the speed of the actuators 119*a,b* extension or retraction to control the opening or closing speed of the door sections 118*a,b*, respectively, to maintain a clearance between the opening or closing door sections 118*a,b* to avoid collisions as described above with respect to the doors sections 108*a,b*.

Embodiments of the present disclosure provide a tong assembly having position sensors for door sections in the power tong and backup tong. The position sensors are monitored to determine position of the door sections and used to determine the door opening and the door closing sequence. Measurements of the position sensors are not dependent on hydraulic power units connected to the tong assembly. Therefore, the tong assembly does not need to be readjusted or fine-tuned when connecting to a new hydraulic power unit, for example when connecting to a new work site, and performs consistently in different work sites and during a period of operation. Additionally, the position sensors provide accurate position of the door sections, thus increasing operation speed because of increased efficiency in opening and closing sequence.

In one embodiment, a controller is used to open and close door sections of a tong of a tong assembly. The tong may be a power tong or a backup tong. The controller initiates a tong opening sequence by commanding a first actuator of the tong to open a first door section of the tong. While the first door section is being opened, a first sensor monitors the position of the first door section. The first sensor is in communication with the controller. When the first sensor determines that the first door section reaches a first threshold position value, the controller commands a second actuator of the tong to open a second door section of the tong. The first threshold position value may correlate to a position of the first door section, as the first door section opens, such that the first door section is clear of a trajectory of the second door section. Prior to or during the opening of the first door section, a latch of the tong configured to selectively lock the first and second door sections together is unlocked by sending an unlocking command to a latch actuator from the controller. The controller may monitor the position of the latch by communicating with a latch sensor, and the controller may open the first and second door sections based on the position of the latch. The controller stops the opening of the first and second door sections when the first and second door sections are fully opened or an opening between the door sections is sufficiently large enough to accommodate a diameter of a tubular.

The controller initiates a door closing sequence by commanding the second actuator to close the second door section. While the second door section is being closed, a second sensor is monitors the position of the second door section. The second sensor is in communication with the controller. When the second sensor determines that the second door section reaches a second threshold position value, the controller commands the first actuator to close the first door section. The second threshold position value may correlate to a position of the second door section such that the second door section is clear of a trajectory of the first door section. After or during the closing of the first door section, the controller sends a locking command to the latch actuator to lock the latch. The controller may monitor the position of the latch with the latch sensor, and the controller may close the first and second door sections based on the position of the latch. When the first and second door sections both closed, the latch may then lock the first and second door sections in the closed position.

In one embodiment, a tong assembly, comprising a back section, an outer door section movably coupled to the back section, and an inner door section movably coupled to the back section. The tong assembly further including a first actuator configured to move the outer door section between an open position and a closed position. The tong assembly further including a second actuator configured to move the inner door section between an open position and a closed position. The tong assembly further including a first sensor positioned to measure a position of the outer door section, and a second sensor positioned to measure a position of the inner door section.

In some embodiments of the tong assembly, the first actuator is a first cylinder coupled between the outer door section and the back section and configured to pivot the outer door section relative to the back section, and the second actuator is a second cylinder coupled between the inner door section and the back section and configured to pivot the inner door section relative to the back section.

In some embodiments of the tong assembly, the first sensor is a length transducer positioned to measure a length of the first actuator, and the second sensor is a length transducer positioned to measure a length of the second actuator.

In some embodiments of the tong assembly, the first sensor is coupled to the first actuator.

In some embodiments of the tong assembly, the first sensor is integrated into the first actuator.

In some embodiments of the tong assembly, the tong assembly further including a controller connected to the first and second sensors, wherein the controller receives measurements of the first and second sensors and generates commands to the first and second actuators to open and close the inner and outer door sections based on measurements of the first and second sensors.

In some embodiments of the tong assembly, the tong assembly further including a latch configured to lock the outer door section and the inner door section at the closed position, a latch actuator configured to move the latch between a locked position and an unlocked position, and a latch position sensor configured to measure a position of the latch.

In one embodiment of the method for operating a tong assembly, comprising moving an outer door section from a closed position towards an open position while monitoring a first position sensor configured to measure a position of the outer door section, and moving an inner door section from a closed position towards an open position when a measurement of the first position sensor reaches a door opening threshold value.

In some embodiments of the method for operating the tong assembly the first sensor is a length transducer coupled to an actuator configured to move the outer door section.

In some embodiments of the method for operating the tong assembly, moving the inner door section and moving the outer door section are performed simultaneously.

In some embodiments of the method for operating the tong assembly, the method further comprising continuously monitoring the first position sensor and a second position sensor configured to measure a position of the inner door section while moving the inner door section and moving the outer door section are performed simultaneously.

In some embodiments of the method for operating the tong assembly, the method further comprising upon opening the outer door section and the inner door section, receiving or releasing a tubular through an opening formed between the outer door section and the inner door section. The method further comprising moving the inner door section from the closed position towards the open position while monitoring a second position sensor configured to measure a position of the inner door section. The method further comprising moving the outer door section from the open position towards a closed position when a measurement of the second position sensor reaches a door close threshold value.

In some embodiments of the method for operating the tong assembly, the method further comprising performing a tubular makeup or break out operation after the outer door section and the inner door section reach the closed position.

In some embodiments of the method for operating the tong assembly, the method further comprising prior to moving the outer door section, moving a latch locking the outer door section and the inner door section at the closed position while monitoring a latch sensor, wherein moving the outer door section is started when measurement of the latch sensor reaches a threshold value.

In one embodiment, a tong assembly includes a power tong, a backup tong, and a controller. The power tong comprising a first frame having a first door section and a second door section, wherein the first door section and the second door section are movable between an open position and a closed position, a first sensor configured to measure a position of the first door section, and a second sensor configured to measure a position of the second door section. The backup tong comprising a second frame having a third door section, and a fourth door section, wherein the third door section and the fourth door section are movable between an open position and a closed position; a third sensor configured to measure a position of the third door section, and a fourth sensor configured to measure a position of the fourth door section. The controller is connected to the first, second, third and fourth sensors and configured to open and close the power tong and the back tong according to the measurements of the first, second, third and fourth sensors.

In some embodiments of the tong assembly, the power assembly further includes a first cylinder coupled to the first door section to open and close the first door section, wherein the first sensor is attached to the first cylinder, and a second cylinder coupled to the second door section to open and close the second door section, wherein the second sensor is attached to the second cylinder.

In some embodiments of the tong assembly, the first and second sensors are length transducers.

In some embodiments of the tong assembly, the first and second sensors are integrated in the first and second cylinders.

In some embodiments of the tong assembly, the tong assembly further includes a hydraulic manifold coupled between the controller and the first and second cylinders, wherein the hydraulic manifold selectively connects the first and second cylinders to a hydraulic power unit.

In some embodiments of the tong assembly, the power assembly further includes a latch configured to lock the first door section and the second door section at the closed position, and a latch position sensor configured to measure a position of the latch.

While the foregoing is directed to embodiments of the present disclosure, other and further embodiments may be devised without departing from the basic scope thereof, and the scope of the present disclosure is determined by the claims that follow.

The invention claimed is:

1. A tong assembly, comprising:

a back section;

an outer door section movably coupled to the back section;

a first actuator configured to move the outer door section between an open position and a closed position;

an inner door section movably coupled to the back section;

a second actuator configured to move the inner door section between an open position and a closed position;

a first sensor positioned to measure a position of the outer door section;

a second sensor positioned to measure a position of the inner door section; and a controller connected to the first and second sensors, wherein the controller receives measurements of the first and second sensors and generates commands to the first and second actuators to open and close the inner and outer door sections based on measurements of the first and second sensors.

2. The tong assembly of claim 1, wherein the first actuator is a first cylinder coupled between the outer door section and the back section and configured to pivot the outer door section relative to the back section, and the second actuator is a second cylinder coupled between the inner door section and the back section and configured to pivot the inner door section relative to the back section.

3. The tong assembly of claim 2, wherein the first sensor is a length transducer positioned to measure a length of the first actuator, and the second sensor is a length transducer positioned to measure a length of the second actuator.

4. The tong assembly of claim 3, wherein the first sensor is coupled to the first actuator.

5. The tong assembly of claim 3, wherein the first sensor is integrated into the first actuator.

6. The tong assembly of claim 1, further comprising:

a latch configured to lock the outer door section and the inner door section at the closed position;

a latch actuator configured to move the latch between a locked position and an unlocked position; and a latch position sensor configured to measure a position of the latch.

7. A method for operating a tong assembly, comprising:

moving an outer door section from a closed position towards an open position while monitoring a first position sensor configured to measure a position of the outer door section; and moving an inner door section from a closed position towards an open position when a measurement of the first position sensor reaches a door opening threshold value.

8. The method of claim 7, wherein the first position sensor is a length transducer coupled to an actuator configured to move the outer door section.

9. The method of claim 7, wherein moving the inner door section and moving the outer door section are performed simultaneously.

10. The method of claim 9, further comprising:

continuously monitoring the first position sensor and a second position sensor configured to measure a position of the inner door section while moving the inner door section and moving the outer door section are performed simultaneously.

11. The method of claim 7, further comprising:

upon opening the outer door section and the inner door section, receiving or releasing a tubular through an opening formed between the outer door section and the inner door section;

moving the inner door section from the closed position towards the open position while monitoring a second position sensor configured to measure a position of the inner door section; and moving the outer door section from the open position towards a closed position when a measurement of the second position sensor reaches a door close threshold value.

12. The method of claim 11, further comprising performing a tubular makeup or break out operation after the outer door section and the inner door section reach the closed position.

13. The method of claim 7, further comprising:

prior to moving the outer door section, moving a latch locking the outer door section and the inner door section at the closed position while monitoring a latch sensor, wherein moving the outer door section is started when measurement of the latch sensor reaches a threshold value.

14. A tong assembly, comprising:

a power tong comprising:

a first frame having a first door section and a second door section, wherein the first door section and the second door section are movable between an open position and a closed position;

a first sensor configured to measure a position of the first door section; and a second sensor configured to measure a position of the second door section; and a backup tong comprising:

a second frame having a third door section, and a fourth door section, wherein the third door section and the fourth door section are movable between an open position and a closed position;

a third sensor configured to measure a position of the third door section; and a fourth sensor configured to measure a position of the fourth door section; and a controller connected to the first, second, third and fourth sensors and configured to open and close the first and the second door sections of the power tong according to the measurements of the first and second sensors, and wherein the controller is configured to open and close the third and the fourth door sections of the backup tong according to the measurements of the third and fourth sensors.

15. The tong assembly of claim 14, wherein the power tong further comprises:

a first cylinder coupled to the first door section to open and close the first door section, wherein the first sensor is attached to the first cylinder; and a second cylinder coupled to the second door section to open and close the second door section, wherein the second sensor is attached to the second cylinder.

16. The tong assembly of claim 15, wherein the first and second sensors are length transducers.

17. The tong assembly of claim 16, wherein the first and second sensors are integrated in the first and second cylinders.

18. The tong assembly of claim 15, further comprising a hydraulic manifold coupled between the controller and the first and second cylinders, wherein the hydraulic manifold selectively connects the first and second cylinders to a hydraulic power unit.

19. The tong assembly of claim 14, wherein the power tong further comprises:

a latch configured to lock the first door section and the second door section at the closed position; and a latch position sensor configured to measure a position of the latch.

* * * * *